US005098487A

United States Patent [19]

Brauer et al.

[11] Patent Number: 5,098,487

[45] Date of Patent: * Mar. 24, 1992

[54] COPPER ALLOYS FOR SHAPED CHARGE LINERS

[75] Inventors: Dennis R. Brauer, Brighton, Ill.; Frank N. Mandigo, North Branford; Derek E. Tyler, Cheshire, both of Conn.

[73] Assignee: Olin Corporation, New Haven, Conn.

[ * ] Notice: The portion of the term of this patent subsequent to Sep. 25, 2007 has been disclaimed.

[21] Appl. No.: 620,190

[22] Filed: Nov. 28, 1990

[51] Int. Cl.[5] ..... F42B 1/032

[52] U.S. Cl. ..... 148/432; 102/307; 102/476; 148/433; 148/434; 148/435; 148/436

[58] Field of Search ..... 148/432–436; 420/469, 473–476, 491; 102/307, 476

[56] References Cited

U.S. PATENT DOCUMENTS

| | | | |
|---|---|---|---|
| 2,870,709 | 1/1959 | Boelter, Jr. | 102/24 |
| 3,025,794 | 3/1962 | Lebourg et al. | 102/24 |
| 3,077,834 | 2/1963 | Caldwell | 102/24 |
| 3,112,700 | 12/1963 | Gehring, Jr. | 102/20 |
| 3,121,389 | 2/1964 | Delacour | 102/20 |
| 3,128,701 | 4/1964 | Rienhart et al. | 102/20 |
| 3,136,249 | 6/1964 | Poulter | 102/309 |
| 3,196,792 | 7/1965 | Charrin | 102/24 |
| 3,255,659 | 6/1966 | Venghiattis | 86/20 |
| 3,375,107 | 3/1968 | Kranz | 428/601 |
| 3,894,867 | 7/1975 | Fishman et al. | 148/432 |
| 4,220,687 | 9/1980 | Christopher | 175/4.6 |
| 4,387,773 | 6/1983 | McPhee | 175/4.6 |
| 4,474,113 | 10/1984 | Kyro et al. | 102/306 |
| 4,494,461 | 1/1985 | Pryor et al. | 102/464 |
| 4,498,367 | 2/1985 | Skolnick et al. | 102/306 |
| 4,638,535 | 1/1987 | Pryor et al. | 29/1.3 |
| 4,766,813 | 8/1988 | Winter et al. | 102/307 |
| 4,794,990 | 1/1989 | Riggs | 175/4.6 |
| 4,840,654 | 6/1989 | Pryor | 65/18.1 |
| 4,862,804 | 9/1989 | Chawla et al. | 102/309 |
| 4,958,569 | 9/1989 | Mandigo | 102/476 |

OTHER PUBLICATIONS

CDA Publication, "Classification of Copper and Copper Alloys", 5th ed., 1952 (420/469).

*Metals Handbook*, 9th ed., vol. 2, pp. 383–439, Amnerican Society for Metals 1979.

Birkhoff et al., entitled "Explosives with Lined Cavities" published in the The Journal of Applied Physics, vol. 19, Jun. 1948 at pp. 563–582.

Von Holle et al., entitled "Temperature Measurement of Shocked Copper Plates and Shaped Charged Jets by Two-Color IR Radiometry" appearing in Journal of Applied Physics, vol. 47, No. 6, Jun. 1976 at pp. 2391–2394.

Hudson et al., entitled "Gunmetal Castings, Their Production, Properties and Application" published by MacDonald & Company Limited, London (1967) at pp. 51–92 and 119–153.

Fascetta et al., entitled "Die Casting Partially Solidified High Copper Content Alloys" appearing in AFS Cast Metals Research Journal (Dec. 1973) at pp. 167–173.

Campbell et al., entitled "Rheocasting and Thixocasting-Review of Progress To-Date" appearing in Foundry Trade Journal (Feb. 27, 1975) at pp. 291–295.

*Primary Examiner*—H. Dean

*Assistant Examiner*—George Wyszomierski

*Attorney, Agent, or Firm*—Gregory S. Rosenblatt; Paul Weinstein

[57] ABSTRACT

A metal liner for a shaped charge device having a ductile metal matrix and a discrete second phase is provided. The allow composition is selected so the second phase is molten when the liner is accelerated following detonation. The molten phase reduces the tensile strength of the matrix so that the liner slug is pulverized on striking a well casing. The slug does not penetrate the hole perforated in the well casing by the liner jet and oil flow into the well bore is not impeded. The liner is formed by directly casting the desired alloy to the desired shape.

30 Claims, 2 Drawing Sheets

COPPER ALLOYS FOR SHAPED CHARGE LINERS

CROSS REFERENCED TO RELATED APPLICATIONS

This application is related to U.S. Pat. No. 4,958,569 entitled "Wrought Copper Alloy Shaped Charge Liner" by Frank N. Mandigo, which issued Sept. 25, 1990.

BACKGROUND OF THE INVENTION

The invention relates to liners for shaped charge devices used to perforate oil well casings and well bore holes. More particularly, the invention relates to an explosive jet liner which perforates an oil well casing without leaving a slug of metal in the resultant hole.

Shaped charges, capable of producing an explosive jet, have been used for many years to perforate oil well bore hole casings. In general, the charges are characterized by a shaped explosive charge housed in a container having one open end. The explosive has a concave surface facing the open end of the container aligned at the point the well casing is to be perforated. The concave surface is lined with a metallic liner to seal off the open end of the charge container. A compressive shock wave generated by detonation of the explosive charge collapses the liner. The inner portion of the liner is extruded into a narrow diameter high speed jet. The jet reaches a speed of about 10,000 m/sec. The remainder of the liner forms a larger diameter slug or "carrot". The slug is slower moving, traveling on the order of about 1000 m/sec and generally follows the path of the jet.

The well casing is perforated at depths where oil bearing earth formations are believed present. Oil flows into the well casing through the perforation holes. The slug has a tendency to embed in the perforated hole impeding the flow of oil into the well casing. The slug may also cause mechanical interlocking between the detonation tube holder which positions the shaped charge and the well casing. Much effort has been exerted to minimize or eliminate the slug.

U.S. Pat. No. 3,077,834 to Caldwell discloses minimizing the slug by forming the liner from loosely packed copper spheres. The spheres may be coated with a low melting metal such as tin to improve adhesion. The slug formed from compacted spheres is porous and fragile. When it strikes the wall of the well casing, the slug pulverizes and does not obstruct the flow of oil. Compacted powder liners now comprise about 90% of the oil well market. The liners are usually a mixture of copper and lead spheres containing about 20% by weight lead.

Compacted powder liners are not ideal. As disclosed in U.S. Pat. No. 3,196,792 to Charrin, cold pressed and/or sintered liners are not watertight. The bore hole is frequently filled with fluid. The liner may leak causing the explosive mixture to get wet and fail to detonate. The cold pressed, unsintered powder liners are fragile and prone to break during handling or assembly. The pressed powder surface has a large surface area producing liners which are hydroscopic. The moisture reduces the effectiveness of the explosive mixture. Compacted liners are formed individually increasing the cost. The uniformity of powder composition and compaction pressure may vary from liner to liner and from region to region within a liner. This variation leads to unpredictable jet performance.

The remaining 10% of the oil well market is comprised of wrought metal liners. Wrought metal liners do not have the problems associated with compacted powder liners. However, wrought liners formed from ductile metals and alloys can form relatively large slugs.

One solution has been bimetallic liners. U.S. Pat. No. 3,025,794 to Lebourg et al discloses a bimetallic liner comprised of a layer of copper and a layer of zinc. The ductile copper forms the perforating jet. The zinc vaporizes as the slug is accelerated eliminating the slug. Bimetallic liners have the disadvantage that two layers are bonded together. The quality of the bond influences the jet performance. The extra forming steps add to the cost of the liner.

Wrought metal liners formed from specific alloys have also been disclosed to minimize slug formation. U.S. Pat. No. 3,128,701 to Rinehart et al discloses liners which melt at temperatures of less than 500° C. Among the alloys and metals disclosed are 50% lead/50% tin, 97.6% zinc/1.6% lead and lead, zinc or cadmium metal. The liners melt as the slug travels to the well casing. The molten slug does not obstruct the perforated hole.

U.S. Pat. No. 3,112,700 to Gehring, Jr. discloses binary eutectic alloy liners. The slug is minimized by forming a highly ductile metal matrix with brittle dendrites, uniformly, but discontinuously dispersed throughout the matrix. Among the eutectic compositions disclosed are 88.8% Pb/11.2% Sb, 61.9% Sn/38.1% Pd and 71.9% Ag/28.1% Cu. While these alloys may reduce slug formation, they are not as easily shaped as more ductile metals such as copper and copper alloys.

U.S. Pat. No. 4,958,569 discloses a wrought metal liner for a shaped charge device having a ductile metal matrix and discrete second phase. The alloy composition is selected so that the second phase is molten when the liner is accelerated following detonation. The molten phase reduces the tensile strength of the matrix so the liner slug is pulverized on impact with a well casing. The slug does not penetrate the hole perforated in the well casing by the liner jet and oil flow is not impeded. Alternatively, the second phase forms discrete crack nucleation sites which result in the slug pulverizing on impact.

The present invention is based on the discovery of a group of castable copper alloys offering advantages similar to those realized from the use of wrought copper alloys as taught in U.S. Pat. No. 4,958,569. In fact, due to the nature of the casting process, certain advantages are realized. For example, a higher concentration of additions may be made to the base alloy. The size of the second phase may be adjusted by control over the cooling rate.

Accordingly, it is an object of the invention to provide a copper alloy which is cast directly to a shape suitable for use in shaped charge liners. It is a feature of the invention that the copper alloy is multiple phase having a ductile matrix and a discrete dispersion of a second phase. It is a further feature of the invention that the second phase may either melt upon detonation of the shaped charge device or form brittle crack nucleation sites. It is an advantage of the invention that by direct casting the shaped charge liners, unique microstructures may be obtained.

Yet another advantage of the invention is that the volume concentration of the second phase may be increased beyond that feasible for wrought alloys. Still another advantage of the invention is that the second phase may be either homogeneous throughout the liner or non-homogeneous. Another advantage of the invention is that additional elements may be added to induce planes of weakness. Still another advantage is the copper alloy liners may be formed by conventional casting or thixoforging.

In accordance with the invention, there is provided a metal liner for a shaped charge device of the type formed from a multiple phase alloy. The liner has a ductile metal matrix and a discrete second phase dispersed within that matrix. The second phase is selected to have a melting temperature less than the temperature reached by the metal liner following detonation. The multiple phase alloy is cast directly to a shape effective to compress on detonation of the shaped charge device.

The above stated objects, features and advantages will become more apparent from the specification and drawings which follow.

IN THE DRAWINGS

DETAILED DESCRIPTION OF THE PREFERRED EMBODIMENT

Figure 1:
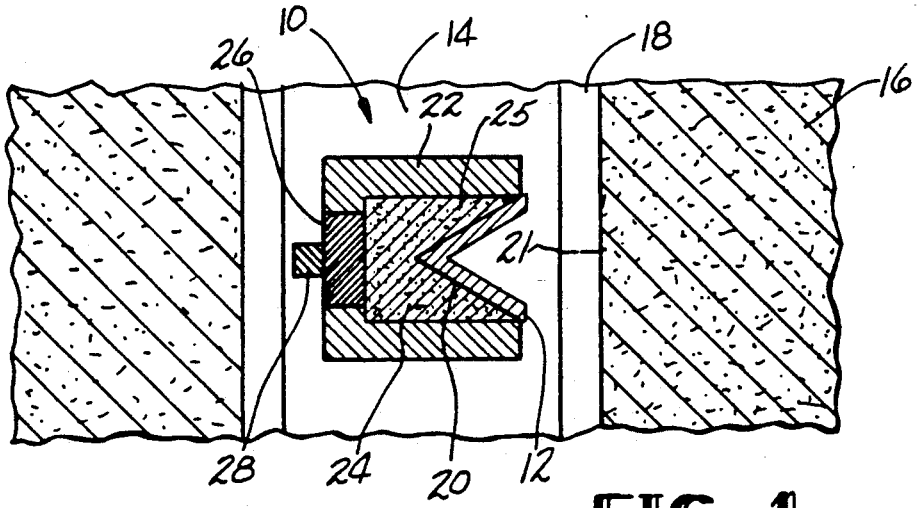
FIG. 1 shows in cross sectional representation a shaped charge for perforating an oil well casing employing the liner of the invention.

FIG. 1 shows in cross sectional representation a shaped charge perforating apparatus 10 employing the cast metal liner 12 of the invention. The shaped charge perforating apparatus 10 is positioned within a well bore 14 which penetrates an oil bearing earth formation 16. A well casing 18 which is usually steel with a thickness of about 0.40 inches maintains the integrity of the well bore. The shaped charge perforating apparatus 10 is suspended in the well bore 14 such that the apex 20 of the concave shaped cast liner 12 is aligned with that portion 21 of the well casing 18 to be perforated.

The shaped charge perforating apparatus 10 is encased in a hollow, substantially cylindrical container 22 which may be made from a suitable metal, plastic or rubber. The internal cavity 24 of the casing 22 has a shape determined by the cast liner 12. The cavity is filled with a suitable explosive 25 such as 75/25 Octol. A booster 26 initiates the explosion when detonator 28 is activated by an operator located on the surface.

When the explosive 25 is detonated, a compressive shock wave is generated. The shock wave compresses the liner 12. The apex 20 of the liner 12 is extruded outwardly at high velocity forming a penetrating jet. The penetrating jet perforates the portion 21 of the well casing 18 facilitating the entry of oil from the oil bearing, earth formation 16. The remainder of the liner 12 forms a slow moving slug which trails the jet. Formation of the slug and jet may be more clearly seen with reference to FIG. 2.

Figure 2:
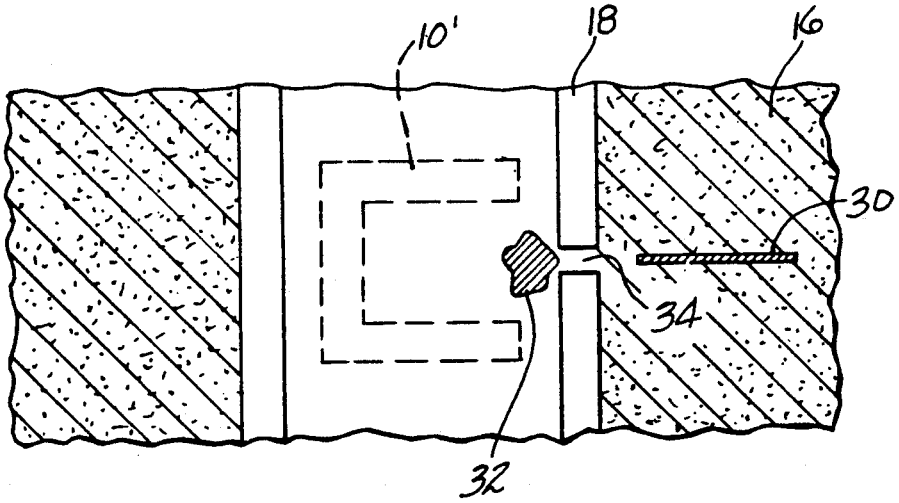
PRIOR ART FIG-2
FIG. 2 shows in cross sectional representation the jet and slug which develop from a prior art liner.

FIG. 2 shows in cross sectional representation, a detonated shaped charge perforating apparatus 10'. The liner, a conventional ductile metal such as copper, is explosively compressed into a rapidly moving jet 30 and a relatively slow moving slug 32. The jet 30 perforates the well casing 18 forming a perforation hole 34. The trailing slug 32 embeds in the perforation hole 34 inhibiting the flow of oil from the oil bearing, earth formation 16.

In accordance with a first embodiment of the invention, the liner is formed from specific metal alloys. The slug is sufficiently weakened that when it strikes the well casing 18 it pulverizes and does not obstruct the perforation hole 34. The cast metal liners of the invention are formed from an alloy which when heated to the temperature reached by the liner after detonation form a ductile matrix and a molten second phase dispersed throughout the matrix.

As disclosed in an article by Von Holle entitled "Temperature Measurement of Shocked Copper Plates and Shaped-Charge Jets by Two-Color IR Radiometry", the detonation process develops a temperature in the range of about 350° C. to about 500° C. in the slug residual. Micrographic examination of wrought liners formed from copper alloy C110 (electrolytic tough pitch copper having the nominal composition 99.90% minimum copper), C260 (cartridge brass having the nominal composition by weight of 70% copper and 30% zinc) and C544 (leaded bronze rods, having the composition 89% copper, 4% lead, 4% tin and 3% zinc) confirms this estimate. An alloy which has a molten phase at this temperature will have the unique characteristic of producing no slug residual.

The desired alloys are multiple phase and comprise a ductile matrix and a discrete second phase. The second phase has a melting temperature less than the temperature reached by the liner after detonation. For ease of formability and maximum jet penetration the matrix is selected to be highly ductile. Preferably, the metal matrix is copper or a copper alloy. The discrete second phase is any elemental or alloy phase with a sufficiently low melting point. The composition of liners formed from wrought alloys is limited. The volume fraction of the second phase must be low enough to ensure the bulk alloy is workable. Cast alloys are not so limited. Significantly higher concentrations of additions may be made to the alloy.

For copper based alloys, lead, bismuth and lithium are preferred alloying elements. Additional elements which do not significantly deteriorate the mechanical properties of the matrix and do not significantly raise the melting temperature of the second phase may also be present.

Among the preferred binary alloys are copper/1-5 wt. % lithium and copper/up to 50% lead. The lead is present in an effective concentration to reduce the tensile strength of the slug. The maximum lead concentration is that which can be dissolved in the copper during casting. Using conventional die casting techniques with stirring, up to about 50 wt. % lead may be added. While die casting is preferred because it is capable of producing high volume castings having tight tolerances, other casting techniques notably sand and centrifugal castings may also be employed. When the cast alloy is cooled, the lead segregates from the copper matrix into discrete pockets of lead. Preferably, the lead is present in a concentration of about 5 to about 30% by weight. Most preferably, the lead concentration is from about 15 to 30 percent by weight. One cast alloy within this compositional range is copper alloy C982 (21-27% by weight lead).

Additions may be made to the binary copper-lead alloy. The addition of tin produces a hard second phase to provide crack nucleation sites. The tin is present in an effective concentration up to about 10% by weight. Preferably, the tin concentration is from about 4% to about 8%.

Nickel additions behave similarly to tin additions and are frequently made in combination with tin. The nickel concentration should be up to about 30% by weight and preferably from about 11% to about 25%.

Silicon additions result in the formation of hard second phase particles. A suitable concentration of silicon is up to about 10% by weight and preferably from about 1% to about 5%.

Aluminum additions also result in the formation of hard second phase particles when added in a concentration of from about 2% to about 15% by weight. Preferably, the concentration of aluminum is from about 4% to about 8%. Lower concentrations of aluminum, i.e. an effective concentration up to about 1% by weight results in the formation of a surface aluminum containing film. By stirring the melt during solidification, such as by electromagnetic stirring, the aluminum bearing film may be dispersed throughout the alloy forming planes of weakness.

Zinc can be added to lower the cost of the alloy by replacing some of the copper. Up to 30% by weight zinc may be added. Preferably, the zinc concentration is maintained between about 2% and 10% by weight.

Suitable quaternary alloys include copper alloy C836 (nominal composition 4-6% by weight lead, 4-6% tin, 4-6% zinc and the balance copper), C838 (5-7% by weight lead, 3.3-4.2% tin, 5-8% zinc and the balance copper) as well as other high lead cast alloys, such as C941 (15-22% by weight lead, 4.5-6.5% tin, up to 3% zinc and the balance copper) and C945 (16-22% lead, 6-8% tin, up to 1.2% zinc and the balance copper). Any of the alloys may include selected additions, such as 0.5-5.0 weight percent phosphorous.

Figure 3:
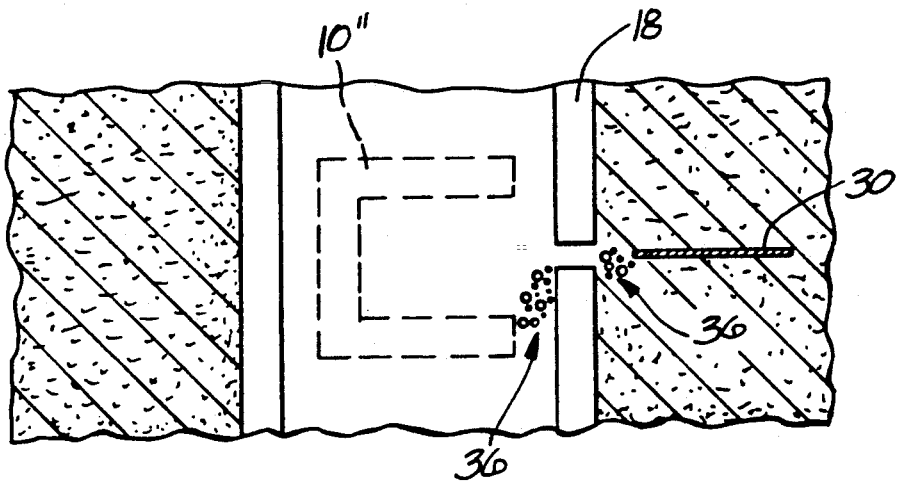
FIG. 3 shows in cross sectional representation the jet and pulverized slug from the liner of the invention.

With reference to FIG. 3, following detonation of the shaped charge perforating apparatus 10'' having a liner cast from an alloy of the invention, the penetrating jet 30 penetrates the well casing 18 forming a perforation hole 34. The slug heats up to a temperature above the melting point of the discrete second phase of the alloy. Molten pockets develop within the alloy, drastically reducing its strength. When the slug strikes the well casing 18, it pulverizes into small metallic particles 36 which either pass through the perforation hole 34 or drop within the well bore 14. The slug is destroyed. The perforation hole is not blocked and oil flow is not impeded.

In a second embodiment of the invention, the second phase does not melt. Rather, the second phase forms crack nucleation sites that cause the slug to break up. Any alloy which forms a ductile metal matrix and a discrete, brittle second phase at the temperature achieved by the slug is satisfactory. Preferably, the metal matrix is copper or a copper alloy and the second phase is present at temperatures in the range of from about 350° C. to about 500° C. The second phase forms crack nucleation sites which decrease the ductility of the slug. The slug pulverizes upon impact with the well casing 18. Alloys in accordance with this embodiment of the invention may be formed from copper and include elements selected from the group consisting of magnesium, phosphorous, tin, zirconium, antimony and mixtures thereof. Preferred alloys are copper/3-6 weight percent magnesium and copper/3-6 weight percent phosphorous.

The multiphase alloy liners of the invention are directly cast to a shape effective to compress upon detonation of the shaped charge. Casting may be by conventional processes such as die or sand casting or include the addition of pressure such as rheocasting, thixoforging or semisolid forging. By direct casting of the multiphase alloy, the volume of the second phase may be tightly controlled. Higher concentrations of the alloying elements may be added than would be possible if the alloy required working.

Additional impurities may be added to the melt to induce planes of weakness. In the preferred copper-lead alloys, aluminum in an effective concentration up to about 1% may be added. Aluminum reacts with dissolved oxygen in the melt to form $Al_2O_3$ particulate. When the melt is cooled below the solidification temperature, aluminum rich particles can agglomerate to form films and clouds that act as crack nucleation sites. The dispersed pockets of lead melt on detonation and the $Al_2O_3$ particulate and film form crack initiation sites. The combination of molten regions and crack initiation sites further weakens the slug to ensure complete pulverization.

Other suitable additives are silicon which results in the production of additional second phase. Phosphorous precipitates as a phosphide inclusion. Manganese, iron, bismuth or antimony and other alloys which precipitate from copper are within the scope of the invention.

Additionally, elements may be added to the copper alloys which effect the particulate size and distribution at a fixed solidification rate. For example, the addition of zinc or nickel to a tin bronze alloy will result in the formation of a delta eutectoid phase. This phase is hard and forms fracture initiation points.

By controlling the solidification rate, the size and distribution of the second phase may be controlled. A higher solidification rate will produce a finer, more uniformly dispersed second phase.

Figure 4:
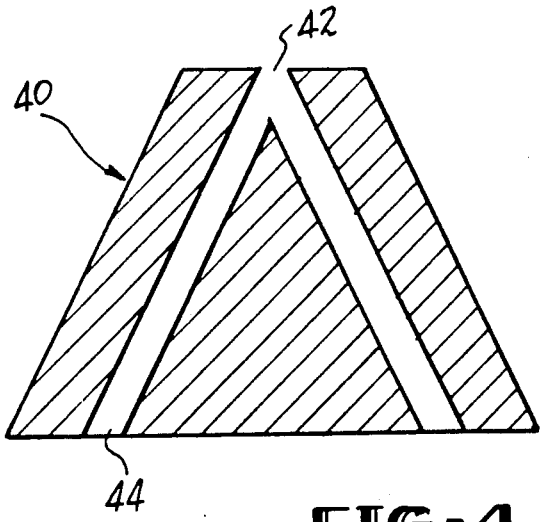
FIG. 4 shows in cross sectional representation a mold for the direct casting of a shaped charge liner according to the invention.

The alloys are cast such as into a mold 40 as illustrated in FIG. 4. The mold is formed from a heat resistant material which does not alloy with molten copper. The mold 40 also has sufficient strength to survive multiple castings. One preferred material is H11 cast iron.

The copper and desired alloying additions are melted by conventional techniques such as induction heating or arc melting. The molten copper alloy is poured into the mold 40 through gate 42. The molten alloy fills the cavity 44 defined by the surfaces of the mold. Dependent on whether a slow solidification rate producing a relatively coarse segregated second phase or a rapid solidification rate resulting in a finer, more evenly dispersed second phase is desired, the mold 40 may be either heated or chilled.

Preferably, the mold temperature is maintained so a cooling rate of approximately 100°-500° C. per second is achieved. Rapid cooling produces a fine grained homogeneous second phase particulate having a size of from about 0.1 to 20 microns. Most preferred is a second phase particulate size of from about 1 to 10 microns.

Conversely, the cooling rate may be much slower, on the order of from about 0.1 to 1° C. per second. This cooling rate will produce a coarse second phase particulate having a size of above about 20 microns. By the casting process, there is no limit to the size of the second phase particles. For optimum liner performance, the maximum dimension of the second phase particulate should be about less than 10% of the wall thickness (about 70 mils) along any horizontal datum plane. Preferably, the maximum dimension of the coarse particulate is from about 20 to about 200 microns.

Figure 5:
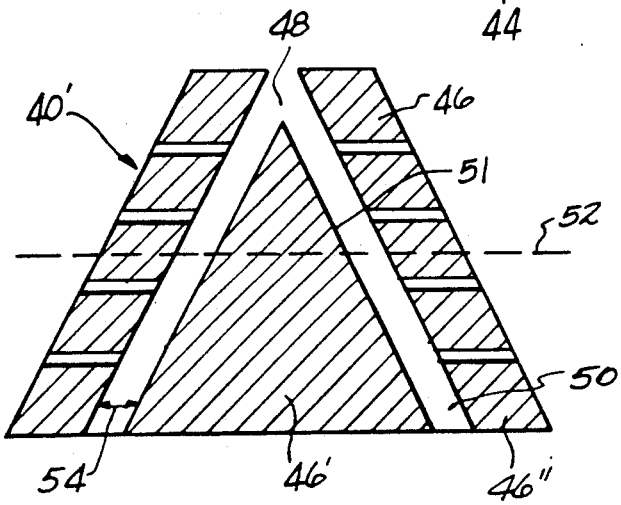
FIG. 5 shows in cross sectional representation a mold for the direct casting of a shaped charge liner having a nonhomogeneous second phase according to an embodiment of the invention.

As shown in FIG. 5, the mold 40' may produce nonhomogeneous liners. By dividing the mold walls 46 into a plurality of regions, each having separately controllable temperatures, the rate of solidification throughout the cast liner may be varied. The apex 48 of the cast liner which contributes most heavily to the perforating jet, is preferably a highly ductile material. The base 50 of the liner contributes most significantly to the slug and is preferably a brittle material. By adjusting the solidification rate, the second phase concentration at the base 50 may be higher than at the apex 48. In this way, a nonhomogeneous liner with superior performance may be formed.

The interior surface of the liner is believed to contribute more heavily to the penetrating jet. By cooling the inner mold portion 46' and maintaining the exterior mold portion 46" at an elevated temperature, the inner surface 51 of the cast liner may be formed from a more ductile alloy than the exterior surface.

Certain liners are tapered, having a thicker wall at the apex of the cone than at the base. The size of the second phase dispersion may be controlled by varying the cooling rate to provide a second phase with a maximum dimension that is a constant percentage of wall thickness along any horizontal datum plane 52. Maintaining a constant volume percent of second phase throughout the tapered liner will give improved performance.

As the copper alloys cool, internal stresses may develop due to the different coefficients of thermal expansion of the various phases of the alloy. This problem is particularly apparent when a high concentration of additives is present. By maintaining the mold 46 at an elevated temperature, below the solidification temperature of the copper alloy matrix, the liner is stress relieved. Stress relieving the liner minimizes subsequent distortion such as when the liner is removed from the mold, or heated or cooled in shipment or storage.

The solidification rate should be uniform at any horizontal datum plane 52. Constancy within a horizontal datum plane is required for the penetrating jet to travel in a straight line.

In addition to the composition and particle size distribution being consistent in any horizontal plane 52, the thickness 54 of the liner must also remain consistent in any horizontal plane. Otherwise, upon detonation the liner will collapse nonuniformly resulting in a penetrating jet with unpredictable properties. While a mold as illustrated in FIGS. 4 and 5, may be machined to tight tolerances, the erosive effect of the molten copper on the H11 cast iron leads to variations in thickness 54. The height of the liner cone relative to its thickness makes it difficult to ensure the base 50 of the cone is uniformly filled. These problems may be avoided by using casting techniques which incorporate pressure to fill the mold. Rheocasting, thixoforging and semisolid slurry casting are examples of pressure aided casting.

In rheocasting, a molten alloy is cooled in a crucible containing a means to stir the melt. As the liquid cools, the first dendrites to separate out are broken up by the stirring action. Eventually, as the melt temperature is reached which produces the desired solid/liquid fraction (typically 30–40% solid), a sample is removed from the crucible and cast. Casting is usually into a pressure die casting machine.

In thixocasting, a rheocast slug is cooled to complete solidification. The slug is then heated to the original mix temperature. The slug remains solid because the welds between dendrites remain intact. However, the eutectic between dendrites is liquid. When the solid slug is subjected to the shearing action of a pressure die casting machine, the bonds between dendrites break and the mixture is converted back to a free flowing slurry.

Figure 6:
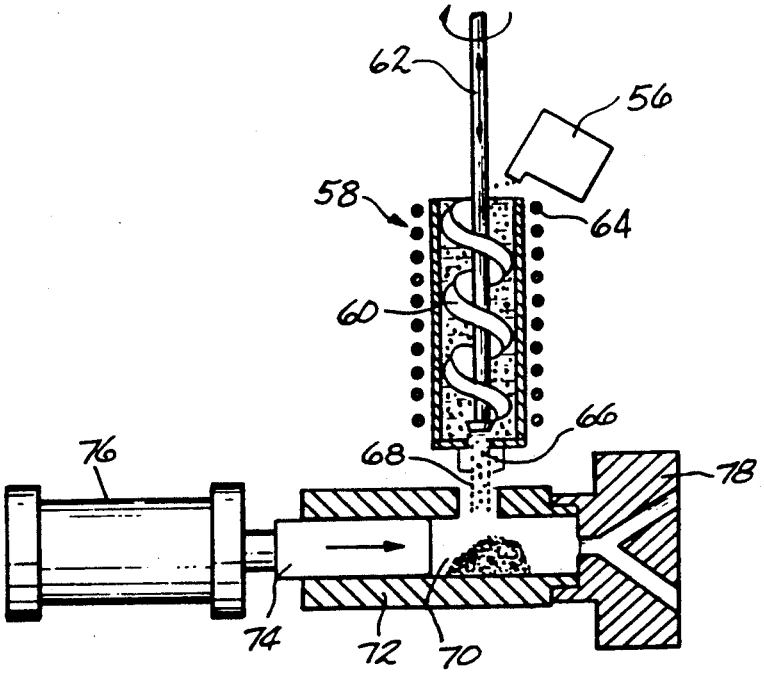
FIG. 6 shows in cross sectional representation a device for casting the liner by thixocasting according to an embodiment of the invention.

FIG. 6 illustrates a casting apparatus for rheocasting liners for shaped charge devices. Molten metal having a desired composition is provided by means of a transfer launder 56 or other conveyance device to a stirring system 58. One copper alloy particularly suited for rheocasting contains 3–20% nickel, 5–10% aluminum and the balance copper. The stirring system contains a suitable stirrer 60 such as an auger. Stirrer 60 may be mounted to a rotatable shaft 62 which is powered by any suitable means (not shown). The stirring means may be mechanical such as a the auger or electromagnetic.

An induction heating coil 64 maintains the temperature of the stirring chamber close to the solidification temperature of the alloy. Shear forces generated by the auger are sufficient to prevent the formation of interconnected dendritic networks, while at the same time allowing the passage of the semisolid slurry through the stirring zone.

An opening 66 is provided at the base of the stirring apparatus 58. The semisolid slurry 68 exits the stirring zone through the opening 66 and is directed to casting chamber 70. The casting chamber 70 contains insulated walls 72 and may include an induction heating means to prevent solidification of the slurry. When a sufficient quantity of slurry is in the die cavity 70, a ram 74 activated by a drive device 76 forces the slurry into the shaped charge liner mold 78. Due to the low viscosity and relatively low temperature of the slurry, wear on the mold is reduced. The low viscosity also ensures the entire base of the liner cone is filled.

The spherical nature of the second phase dispersoid due to the effects of stirring also leads to a finer distribution of second phase particles providing the thixocast liner with an improved microstructure.

Other forms of direct casting such as spray casting and rapid solidification may also provide the alloys of the invention with unique microstructures useful as shaped charge liners.

While the cast alloys have been described as being cast from a homogeneous melt solution, cast suspensions are also within the scope of the invention. For example, particles of silicon carbide, titanium nitride, or aluminum oxide having as desired average particulate size may be dispersed through a copper melt. By rapidly solidifying the melt, the particles may be frozen in place as a uniform dispersion.

The patents and publication cited herein are intended to be incorporated by reference.

It is apparent that there has been provided in accordance with this invention a direct cast shaped charge liner which fully satisfies the objects, features and advantages set forth hereinbefore. While the invention has been described in combination with the specific embodiments thereof, it is intended that many alternatives, modifications and variations will be apparent to those skilled in the art in light of the foregoing description. Accordingly, it is intended to embrace all such alternatives, modifications and variations as fall within the spirit and broad scope of the appended claims.

We claim:

1. A metal liner for a shaped charge device, consisting essentially of:

a multiple phase alloy having a ductile metal matrix and a discrete second phase dispersed in said matrix, said second phase having a melting temperature less than the temperature reached by said metal liner following detonation of an explosive charge in said line, said metal liner cast directly to a shape effective to compress on detonation of said explosive charge.

2. The metal liner of claim 1 wherein said ductile metal matrix consists essentially of copper or a copper alloy.

3. The metal liner of claim 2 wherein said second phase is molten at a temperature in the range of from about 350° C. to about 500° C.

4. The metal liner of claim 3 wherein said second phase includes at least one element selected from the group consisting of lead, bismuth and lithium.

5. The metal liner of claim 4 wherein said alloy contains lead in a concentration of from that amount effective to reduce the tensile strength of the slug generated by detonation to about 50 weight percent.

6. The metal liner of claim 5 wherein the concentration of lead is from about 5 to about 30 weight percent.

7. The metal liner of claim 6 wherein the concentration of lead is from about 15 to about 30 weight percent.

8. The metal liner of claim 7 wherein the concentration of lead is from about 21 to about 27 weight percent.

9. The metal liner of claim 6 wherein an effective amount of at least one additional element has been added to form planes of weakness within said alloy.

10. The metal liner of claim 9 wherein said additional alloying element is selected from the group consisting of tin, nickel, silicon, aluminum, phosphorous, manganese, iron, bismuth, antimony and mixtures thereof.

11. The metal liner of claim 10 wherein said additional element is tin at a concentration of from that effective to provide crack nucleation sites to about 10 weight percent.

12. The metal liner of claim 11 wherein said tin is present in a concentration of from about 4% to about 8%.

13. The metal liner of claim 10 wherein said additional element is nickel at a concentration of from that amount effective to provide crack nucleation sites to about 30 percent by weight.

14. The metal liner of claim 13 wherein said nickel is present in a concentration of from about 11% to about 25%.

15. The metal liner of claim 10 wherein said additional element is silicon at a concentration of from that amount effective to provide hard second phase particles to about 10 weight percent.

16. The metal liner of claim 15 wherein said silicon is present in a concentration of from about 1% to about 5%.

17. The metal liner of claim 10 wherein said additional element is aluminum at a concentration of from that amount effective to provide hard second phase particles to about 15 percent by weight.

18. The metal liner of claim 17 wherein said aluminum is present in a concentration of from about 4% to about 8%.

19. The metal liner of claim 17 wherein said aluminum is present in a concentration of up to 1% and dispersed as a film throughout said matrix.

20. The metal liner of claim 10 wherein said additional element is phosphorus present in a concentration of from about 0.5 to 5.0 weight percent.

21. The metal liner of claim 10 cast from an alloy containing from about 4 to about 6 weight percent lead, from about 4 to about 6 weight percent zinc and the balance copper.

22. The metal liner of claim 10 cast from an alloy containing from about 5 to about 7 weight percent lead, from about 3.3 to about 4.2 weight percent tin, from about 5 to about 8 weight percent zinc and the balance copper.

23. The metal liner of claim 10 cast from an alloy containing from about 15 to about 22 weight percent lead, from about 4.5 to about 6.5 weight percent tin, up to 3 weight percent zinc and the balance copper.

24. The metal liner of claim 10 cast from an alloy containing from about 16 to about 22 weight percent lead, from about 6 to about 8 weight percent tin, up to 1.2 weight percent zinc and the balance copper.

25. A metal liner for a shaped charge device, consisting essentially of:

a multiple phase alloy having a ductile metal matrix and a discrete second phase dispersed in said matrix, said second phase remaining as a precipitate dispersed in said matrix at the temperature reached by said metal liner following detonation of an explosive charge in said liner, said metal liner directly cast to a shape effective to compress on detonation of said explosive charge.

26. The metal liner of claim 25 wherein said ductile metal matrix consists essentially of copper or a copper alloy.

27. The metal liner of claim 26 wherein said second phase is selected to have a composition which will remain a precipitate in said copper or copper alloy matrix at a temperature of from about 350° C. to about 500° C.

28. The metal liner of claim 27 wherein said second phase includes at least one element selected from the group consisting of magnesium, phosphorus, tin, zirconium and antimony.

29. The metal liner of claim 28 wherein said alloy contains from about 3 to about 6 weight percent magnesium.

30. The metal liner of claim 28 wherein said alloy contains from about 0.5 to about 5.0 weight percent phosphorous.

* * * * *